US006014964A

United States Patent [19]

Tidman

[11] Patent Number: 6,014,964

[45] Date of Patent: Jan. 18, 2000

[54] METHOD AND APPARATUS FOR MOVING A MASS IN A SPIRAL TRACK

[75] Inventor: Derek A. Tidman, McLean, Va.

[73] Assignee: Advanced Launch Corporation, McLean, Va.

[21] Appl. No.: 09/181,673

[22] Filed: Oct. 29, 1998

[51] Int. Cl.[7] ..... F41B 3/04

[52] U.S. Cl. ..... 124/6; 124/1; 74/86

[58] Field of Search ..... 124/1, 3, 4, 6, 124/81; 74/86, 87; 89/8

[56] References Cited

U.S. PATENT DOCUMENTS

| | | | |
|---|---|---|---|
| 2,644,270 | 7/1953 | Marong | 446/170 |
| 2,684,062 | 7/1954 | Rose | 124/6 |
| 3,185,479 | 5/1965 | Ortega | 473/509 |
| 4,238,968 | 12/1980 | Cook | 74/84 R |
| 4,632,086 | 12/1986 | Rutten | 124/6 |
| 4,881,446 | 11/1989 | Marks et al. | 89/8 |
| 4,942,775 | 7/1990 | Monkewitz et al. | 73/865.3 |
| 5,388,470 | 2/1995 | Marsh | 74/84 R |
| 5,429,030 | 7/1995 | Tidman | 89/7 |
| 5,699,779 | 12/1997 | Tidman | 124/6 |

FOREIGN PATENT DOCUMENTS

| | | | |
|---|---|---|---|
| 869555 | 2/1942 | France | 124/6 |
| 526908 | 7/1940 | United Kingdom | 124/6 |

OTHER PUBLICATIONS

Tidman et al., "Sling Launch of Materials into Space", Conference on Space Manufacturing, Space Studies Institute, Princeton, NJ, May 4–7, 1995.

*Primary Examiner*—John A. Ricci

*Attorney, Agent, or Firm*—Lowe Hauptman Gopstein Gilman & Berner

[57] ABSTRACT

The velocity of a mass is monotonically increased from an initial non-zero value at the time it enters a spiral track. A drive gyrates the track about an axis so the mass makes each turn around the track in about the same period of time. The drive includes plural rotary drive shafts eccentrically and fixedly connected to the track at several points. The drive shafts and track are arranged so points on a first side of a particular spiral turn where the mass is located are driven toward the axis and points on a second side of the particular spiral turn remote from where the mass is located are driven away from the axis.

44 Claims, 2 Drawing Sheets

METHOD AND APPARATUS FOR MOVING A MASS IN A SPIRAL TRACK

FIELD OF INVENTION

The present invention relates generally to a method of and apparatus for moving a mass in a track and more particularly to such a method and apparatus wherein the mass is moved along a track having a spiral path by moving a portion of the track where the mass is located substantially radially along a local radius of curvature of the spiral track.

BACKGROUND ART

My U.S. Pat. No. 5,699,779 issued Dec. 23, 1997, discloses a method of and apparatus for smoothly moving a mass located in a track having a closed continuous smooth track. The mass is moved, usually accelerated, by moving the track so a portion of the track where the mass is located is moved substantially radially along a local radius of curvature of the track. In the specific embodiment disclosed in the aforementioned patent, the track has a closed circular path. To accelerate the mass, a drive arrangement monotonically increases the track speed. The drive arrangement includes at least one and preferably plural rotating shafts eccentrically connected to the track by crank arms carrying counterweights.

The drive mechanism turns the track through several revolutions until the mass has been accelerated to a desired speed. Then, the track path changes to alter the mass trajectory to eject the mass from the track. To this end, the circular track includes a segment that is swung outwardly during the last revolution of the mass around the track in order to eject the mass from the closed continuous smooth track.

I now realize there are certain problems with the specific arrangement disclosed in my patent for those applications in which a continuous series of shots is required. For such purposes it is desirable to have an arrangement in which a mass passing through the system traverses each portion of the track only a single time. A second mass can then be injected for acceleration through the system before the first mass has emerged, while power input to the track maintains the track at constant speed.

Accordingly, an object of the invention is to provide a new and improved method of and apparatus for moving a mass in a track.

Another object of the invention is to provide a new and improved method of and apparatus for accelerating a mass in a track that is driven at constant speed.

A further object of the invention is to provide a new and improved method of and apparatus for accelerating a mass in a track that is arranged so the mass does not encounter wake created during a previous revolution of the mass about the track.

An additional object is to provide a new and improved method of and apparatus for accelerating a series of masses through a track while maintaining a constant speed of the track.

SUMMARY OF THE INVENTION

In accordance with one aspect of the invention, a mass located in a track having a spiral smooth path is moved by moving the path so a portion of the spiral path where the mass is located is moved substantially radially along a local radius of curvature of the spiral path.

Another aspect of the invention relates to an apparatus for monotonically changing the velocity of a mass from an initial non-zero velocity to another non-zero velocity. The apparatus comprises a spiral track having a first end for receiving the mass while the mass is at the initial velocity. The mass moves in the track after having been received in the track. A drive gyrates the spiral track about an axis as the mass is moving in the spiral track. The drive and track are arranged to cause the mass to change velocity from the initial velocity to another velocity.

The mass is preferably accelerated by gyrating the spiral path at constant frequency as the mass moves outwardly in the spiral path. The path gyration is such as to cause the mass to move about each turn of the path over about the same time interval. Since each spiral turn has a progressively longer length and the mass takes about the same time to traverse each turn, the mass is accelerated. The mass is fed to an inner part of the spiral at a finite, non-zero initial speed. The initial speed of the mass, the path constant gyration speed and the spiral shape are such that the mass is preferably accelerated in phase with the spiral gyration. The path is gyrated so the velocity, V, of the mass at a portion of the spiral path having a radius R is $$V = V_I \frac{R}{R_I} \tag{1}$$

where $R_I$ is the radius of the spiral path where the mass enters the spiral path, and $V_I$ is the initial speed of the mass where the mass enters the spiral path at radius $R_I$. The path is gyrated and can for example be shaped as an Archimedes spiral so that the path distance $R(\phi)$ from a center point of the spiral is given by $$R_I + K(\phi - \phi_I) \tag{2}$$

where K is a constant and $(\phi - \phi_I)$ is the angle around the spiral from the region of the spiral where the mass enters the spiral path at speed $V_I$ and $\phi_I$ is the angle where the mass enters the spiral.

According to one embodiment, the spiral path is controlled in response to a determined position of the mass in the path. Mass position is determined by a sensory arrangement or from preprogrammed values for the position of the mass as a function of time. The path is relatively rigid and is gyrated so a portion of the path approximately diametrically opposed from the portion of the path where the mass is located is moved in the opposite sense along its local radius of curvature from the direction the path is moved where the mass is located. The gyration is also such that the path portion where the mass is located is moved inwardly and the path portion approximately opposite from where the mass is located is moved outwardly.

The path is preferably gyrated by a drive mechanism including at least one and preferably plural rotating shafts distributed about the path and which rotate at the same constant speed. Each of the rotating shafts is eccentrically connected to the path by a crank. To minimize friction and increase mass speed, the mass moves in a path having lower than atmospheric pressure and the mass is levitated magnetically or moves with low friction on a thin film of gas that acts as a gas bearing.

The above and still further objects, features and advantages of the present invention will become apparent upon consideration of the following detailed descriptions of several specific embodiments thereof, especially when taken in conjunction with the accompanying drawings.

DESCRIPTION OF PREFERRED EMBODIMENT

Figure 1:
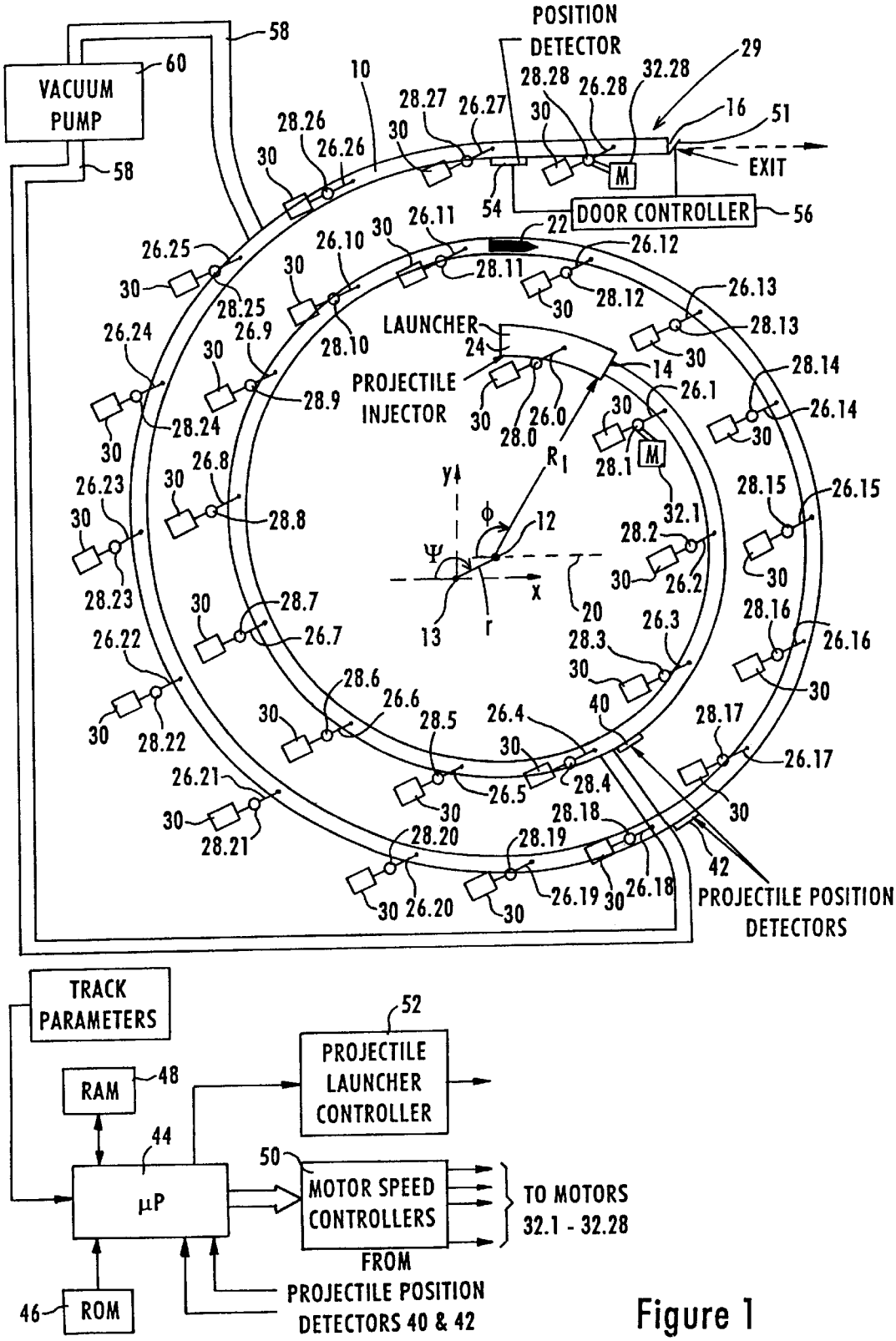
FIG. 1 is a top schematic view of a preferred embodiment of the present invention.

Reference is now made to FIG. 1 wherein a relatively rigid, enclosed, sealed track 10 having a spiral path extends about its central axis point 12 and includes entrance 14 as well as exit 16. Axis point 12 of track 10 is gyrated about axis 13, displaced from point 12 by distance r, to accelerate a mass in the form of projectile 22 from an initial velocity $V_I$ that the projectile has when it passes through entrance 14 to a final velocity $V_F$ the projectile has as it passes through exit 16. Axis 13 is the origin of a Cartesian coordinate system including horizontal and vertical axes x and y. The instantaneous gyration angle of spiral central point 12 relative to axis 13 is Ψ. Injector 24, fixedly attached to spiral 10 at entrance 14, injects projectile 22 into entrance 14 with the initial velocity $V_I$.

Injector 24, preferably an electrothermal device such as disclosed in Tidman et al., U.S. Pat. No. 5,429,030, injects projectile 22 through entrance 14 into track 10 with the predetermined velocity $V_I$ relative to the gyrating motion of the track relative to axis 12 at a predetermined precise time. Injector 24 may have the same pitch as the remainder of spiral 10 but can have other shapes, such as being straight.

A drive for gyrating track 10 relative to axis 13 includes at least one and preferably many eccentrically mounted crank arms 26. In the illustrated embodiment, one end of each of crank arms 26.1–26.28 is pivotably connected to equally spaced points along the length of track 10 between entrance 14 and exit 16, while one end of crank arm 26.0 is pivotably connected to injector 24. Each of crank arms 26 has a center point fixedly connected to a rotary electric motor shaft 28 and a second end carrying counterweight 30. The eccentric distance between the point of each of crank arm 26 connected to shaft 28 and the point where each crank arm is connected to track 10 is the same, equal to r. Each of drive shafts 28 is preferably connected to a different variable speed DC motor 32. In general, motors 32 drive shafts 28 at the same constant speed, which can be selected as a function of several factors, e.g., desired final speed and projectile parameters. In the specific illustrated embodiment of FIG. 1, each of the crank arms 26.1–26.28 is respectively driven by an associated rotary drive shaft 28.1–28.28, in turn driven by DC motors 32.1–32.28 (for convenience only motors 32.1 and 32.28 are shown on the drawing.) In addition, crank arm 26.0 and rotary drive shaft 28.0 preferably are pivotably connected to injector 24 so the injector is driven in synchronism with the remainder of spiral track 10; motor 32.0 drives shaft 28.0.

The speeds of shafts 28, the connections of crank arms 26 to track 10, the shape of the spiral track and the coefficient of friction, $\mu$, between projectile 22 and the track are such that the projectile is accelerated through each turn of the spiral over the same time interval. Because the travel distance of projectile 22 around each turn of spiral path 10 increases and the time the projectile takes to make each turn remains substantially constant, projectile 22 has increasing velocity as it advances along spiral track 10. The final velocity $V_F$ of projectile 22 as it moves through exit 16 is:

$$V_F = V_I \frac{R_F}{R_I} \tag{3}$$

where $R_F$ is the distance of the beginning of the straight section 29 of exit 16 from axis 12; $V_I$ and $R_I$, which are defined supra, are such that $R_I$ is the radial distance of entrance 14 from axis 12.

Drive shafts 28 and track 10 are arranged so points on a first side of a particular spiral turn where projectile 22 is located are driven by shafts 28 generally toward spiral axis 12 while points on a second side of that particular spiral turn remote from where the projectile is located are driven by shafts 28 generally away from the spiral axis. In the example of FIG. 1, projectile 22 is on track 10 at the end of the track first turn where cranks 26.11 and 26.12 are connected to the track; the ends of cranks 26.4 and 26.5 are connected to points on track 10 that are approximately diametrically opposed to projectile 22. In this situation eccentric cranks 26.11 and 26.12 are phased and located so the ends thereof connected to the spiral track are farther from spiral axis 12 than shafts 28.11 and 28.12, while the ends of cranks 26.4 and 26.5 connected to track 10 are between axis 12 and shafts 28.4 and 28.5. Thus, in the example of FIG. 1 the portion of track 10 where projectile 22 is located is outside a local mean position of the track while the portion of track 10 opposite from projectile 22 is inside a local mean position of the track. The spiral shown in FIG. 1 has a clockwise sense and the projectile 22 moves along the spiral in a clockwise angular direction. For acceleration, crank arms 26.0–26.28 move track 10 around in a circular gyrational motion having a clockwise sense, so that the relative position of track 10, shafts 28, and axis 12 remains approximately as shown relative to the projectile position as projectile accelerates along the spiral.

Spiral track 10, as driven by eccentric cranks 26, exerts a Coriolis force on projectile 22 to accelerate the projectile from its initial velocity $V_I$ to its final velocity $V_F$. The centrifugal force of the projectile on the track also causes displacement waves to be established in track 10 as projectile 22 is accelerated through the track.

Injector 24 is preferably an electrothermally ignited gun because such a gun enables projectile 22 to be injected through entrance 14 at a high velocity and at a precise predetermined time relative to the gyration of spiral 10 about axis 13. Projectile 22 is preferably injected through entrance 14 with an initial velocity that is greater than the velocity of displacement waves of track 10. Projectile 22 advances into track 10 without encountering its own wake. The wake results from gases given off by a gas bearing between the projectile and the track along which the projectile moves with a low friction coefficient. This is in contrast to the prior art circular track in which the projectile continuously passes through the same track region cycle after cycle.

The same spiral track 10 can accelerate projectiles of various shapes and masses because the Coriolis and drag forces of the spiral track are approximately proportional to $$m\frac{V^2}{R} \tag{4}$$

where m is the mass of projectile 22, R is the radial distance from spiral axis 12 to projectile 22 as the projectile is being accelerated about track 10 and V is the instantaneous velocity of the mass at radial distance R.

Spiral track 10 requires only a relatively low number of of turns, for example 10 turns, to accelerate projectile 22 from a low initial velocity to a high final velocity. Projectile 22 gains velocity through each inner turn comparable to the velocity gains in the outer turns. Typically, the entire length of track 10 from entrance 14 to exit 16 is about five or more times the length of the outer turn of the spiral. An advantage of the spiral track arrangement of FIG. 1 relative to the prior art circular track is the spiral track lower power train mass. The constant gyration speed of the spiral, which is attained before firing a mass through the system, can be established with relatively low power prior to the shot.

A common aspect of the prior art circular track and the spiral track of the present invention is that a portion of the track where the projectile is located is moved substantially radially along the track local radius of curvature. In the spiral track 10, projectile 22 is accelerated by gyrating the track center point, i.e., spiral axis 12, about axis 13 so the track at the location of the projectile moves inwardly relative to the track center point.

The equations of motion for projectile 22 moving along spiral track 10 differ from those of the prior art circular track since the local radius of the spiral is a function of the angle $\phi$ and is not a constant. A detailed analysis of both the ring and the spiral track systems has been published in the literature ("Slingatron Mass Launchers" by Derek A. Tidman, *Journal of Propulsion and Power*, Vol 14, No. 4, pages 537–544, July–August, 1998), which is incorporated therein by reference.

In accordance with one embodiment, each of motors 32.0–32.28 is optimally driven at a constant rotation speed while projectile 22 is traversing track 10, preferably formed as an evacuated guide tube. The constant speed of each of motors 32.0–32.28 is reached before projectile 22 is launched by injector 24 and is maintained during the entire time projectile 22 is traversing track 10, from the time the projectile enters the track through entrance 14 until the time the projectile leaves the track at door 16. The constant rotation speed of each of motors 32.0–32.28 is preselected so projectile 22 is constantly accelerated in track 10, so that the projectile traverses each loop of the spiral in the same time. In many instances, the need for a projectile sensory system and feed back control of the speeds of motor 32 is unnecessary. For projectile acceleration to occur without feed-back control, it is necessary to inject the projectile with a velocity $$V_I = 2\pi R_I f \tag{5}$$

where f, in cycles per second, is the constant gyration frequency of the spiral. It is also preferable to inject the projectile so that the relative phase angle $\Psi-\phi$ between the phase $\Psi$of the gyration arms and phase $\phi$of the projectile in FIG. 1, lies in the range $$\sin^{-1}\left(\frac{\mu R}{r}\right) < \psi - \phi < \frac{\pi}{2} \tag{6}$$

where $\mu$ is the coefficient of friction between projectile 22 and track 10 as the projectile moves along the track. Under these circumstances the relative phase $\Psi-\phi$ undergoes only small damped variations from its injected value as the projectile is accelerated along the spiral.

It may be necessary, under certain circumstances, to modify slightly the speeds of motors 32.0–32.28 to achieve the desired motion of projectile 22 along the spiral. To this end, projectile position detectors 40 and 42 which are, for example, optical detectors, are positioned approximately one-third of the way around the first and second turns of track 10. Each of projectile detectors 40 and 42 derives a signal as projectile 22 passes it. The signals derived by projectile detectors 40 and 42 are supplied to microprocessor 44, also responsive to preprogrammed signals from read only memory (ROM) 46 and signals from random access memory (RAM) 48. The signals stored in ROM 46 indicate the times when projectile 22 should have passed each of detectors 40 and 42 relative to the time the projectile passes through entrance 14, as stored in RAM 48. Microprocessor 44 responds to the signals from memories 46 and 48 to control the speeds of DC motors 32.0–32.28 via motor speed controllers 50, one of which is provided for each of motors 32.0–32.28. In addition, microprocessor 44 responds to the signals from memories 46 and 48 to control projectile injector controller 52, which in turn controls energization of projectile injector 24.

Initially, microprocessor 44 responds to the signals from ROM 46 to bring motors 32.0–32.28 up to the same, constant speed. When motors 32.0–32.28 have been brought up to speed by microprocessor 44, as detected by a speed detector (not shown) on each of motors 32.0–32.28, the microprocessor activates projectile injector controller 52, whereby electrothermal projectile injector 24 is activated. Activation of projectile injector 24 is timed to provide the correct phase relationship for the position of projectile 22 relative to the position of the track center point 12 about axis 13 as the projectile enters track 10 through entrance 14.

Projectile detector 40 responds to the movement of projectile 22 past it. Microprocessor 44 responds to the signal from detector 40 and compares the time when the projectile passes detector 40 with a preprogrammed time for the projectile to pass detector 40 as stored in read only memory 46. In response to the comparison of the actual time when projectile 22 passes detector 40 and the preprogrammed time for the projectile to pass detector 40, microprocessor 44 generates a signal to control the speeds of motors 32.0–32.28. If the detected and preprogrammed times are the same, no change is made to the speeds of motors 32.0–32.28. If, however, detector 40 indicates projectile 22 passes the detector at a time prior to the time when the projectile should have passed that detector, microprocessor 44 issues a command to controllers 50, to increase the speed of each of motors 32.0–32.28 by the same, appropriate amount. Conversely, if projectile 22 passes detector 40 at a time subsequent to when the projectile should have passed the detector, microprocessor 44 supplies motor speed controllers 50 with a signal commanding the speed of each of motors 32.0–32.28 to decrease by the same, appropriate amount. The same type of operation occurs in response to projectile 22 passing detector 42.

Track 10 is an evacuated guide tube connected to an appropriate vacuum pump 60, to reduce the frictional forces between projectile 22 and the track interior. Consequently, the portion of the guide tube interior adjacent exit 16 must be isolated from atmospheric pressure outside the evacuated guide tube. To these ends, exit door 51 is normally closed and sealed to exit 16. Door 51 remains closed until projectile 22 is about to emerge from track 10. To these ends, projectile position detector 54 is located on track 10 between the connection locations of eccentric arms 26.27 and 26.28 to the track. As projectile 22 passes detector 54, detector 54 supplies a signal to door controller 56. Door controller 56 responds to the signal from detector 54 to open door 51 and release the subatmospheric pressure in the evacuated guide tube comprising track 10 to atmospheric pressure, thereby permitting projectile 22 to move freely from the interior of the guide tube to the atmosphere outside of the guide tube.

Vacuum pump 60, connected to track 10 by tubes 58, evacuates track 10 prior to injection of projectile 22 into track 10. Tubes 58 are disconnected from track 10 just before motors 28 begin to gyrate spiral tube 10.

Figure 2:
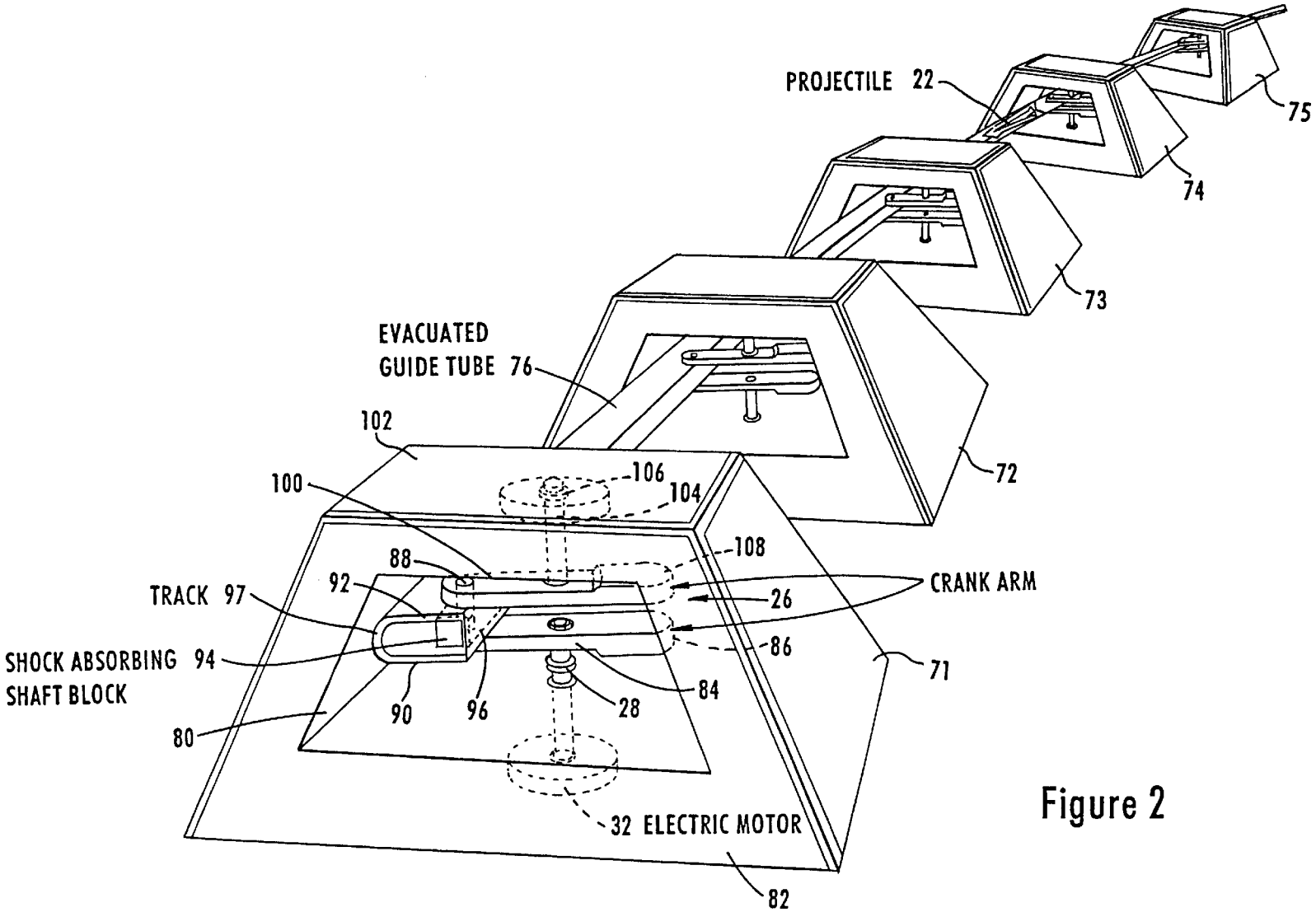
FIG. 2 is a perspective view of a portion of the structure illustrated in FIG. 1.

A preferred configuration of a portion of the apparatus schematically illustrated in FIG. 1 is illustrated in FIG. 2 as including five identical, fixedly mounted housings 71–75 carrying evacuated guide tube 76 that comprises track 10, FIG. 1. In FIG. 2, projectile 22 is illustrated as being in evacuated tube 76 between housings 73 and 74. Since each of housings 71–75 is identical, only housing 71 is described in detail.

Housing 71 includes a central opening 80 through which guide tube 76 extends longitudinally and in which the guide tube gyrates. Housing 71 includes base 82 to which is fixedly mounted DC electric motor 32 having a vertically extending shaft 28 having an upper end fixedly connected to a central portion of horizontally extending arm 84, forming a portion of a crank arm 26. One end of arm 84 has a large relatively heavy portion 86, forming counter weight 30, FIG. 1. The other end of arm 84 is fixedly connected to vertically extending pin 88. Pin 88 extends through upper and lower horizontally extending walls 90 and 92 of guide tube 76, as well as through shock absorbing block 94, in the interior of the guide tube between the horizontally extending walls. Shock absorbing block 94 is fixedly secured to horizontally extending walls 90 and 92, as well as vertically extending, straight wall 96 of the guide tube 76.

Crank arm 26 also includes horizontally extending arm 100 aligned with and having the same shape as arm 84. Arm 100 is mounted to roof 102 of housing 71 by shaft 104, journaled in the roof by bearings 106. One end of arm 100 includes enlarged portion 108, aligned with enlarged portion 86 of arm 84. The other end of arm 100 is fixedly connected to the upper portion of pin 88. Shaft 104 is fixedly connected to the center portion of arm 108, so shafts 28 and 106 are in vertical alignment. End portion 97 of guide tube 76, opposite from wall 96, is curved to correspond with a curved side surface of projectile 22.

To minimize friction of projectile 22 in guide tube 76, the bearing surface of the projectile can be displaced from the track so that direct sliding contact is avoided between the solid material of the projectile and the solid material of the track. This can be achieved by supplying a thin film of high pressure gas that constitutes a low friction gas bearing between projectile 22 and the interior walls of guide tube 76. The required gas can be supplied by a layer of combustible material on the exterior portion of projectile 22 immediately adjacent to the interior wall of guide tube 76. The combustible material is ignited due to friction between projectile 22 and track 10. Alternatively, the gas can be supplied by a layer of material on projectile 22 that evaporates due to viscous dissipation in the gas bearing. The gas forming the gas bearing becomes extremely hot at high velocities of projectile 22, such as above about 1 kilometer per second, to evaporate the material on the projectile. Magnetic levitation can also be employed as described in my previously issued patent.

While there have been described and illustrated specific embodiments of the invention, it will be clear that variations in the details of the embodiments specifically illustrated and described may be made without departing from the true spirit and scope of the invention as defined in the appended claims. For example, the spiral turns can be closely packed and abut, in which case the turns are gyrated at increasing speeds as projectile travel time increases. Also, the circular track of my earlier patent and the spiral track of this invention can be combined so that the projectile first traverses the circular track one or more times and then traverses the spiral track.

I claim:

1. A method of smoothly moving a mass located in a track having a smooth spiral path comprising the step of moving the path so a portion of the spiral path where the mass is located is moved substantially radially along a local radius of curvature of the spiral path.

2. The method of claim 1 wherein the mass is accelerated by gyrating the path as the mass moves outwardly at its local position in the spiral path.

3. The method of claim 1 wherein the mass is moved by gyrating the path so the mass traverses each complete turn of the path during about the same time interval.

4. The method of claim 3 wherein the mass is accelerated and moves outwardly by gyrating the path at constant frequency.

5. The method of claim 1 further including feeding the mass at a non-zero speed to an inner part of the spiral track.

6. The method of claim 5 wherein the non-zero speed exceeds a mechanical wave speed of the track.

7. The method of claim 1 wherein the mass is accelerated by gyrating the path so the mass traverses each complete turn of the path during about the same time interval so the mass moves outwardly in the spiral path, and accelerating the mass in phase with the spiral gyration.

8. The method of claim 7 further including feeding the mass at non-zero speed to an inner part of the path, the non-zero speed exceeding a mechanical wave speed of the track, the non-zero speed at which the mass is fed to the inner part of the spiral path and the gyration speed and the shape of the spiral being such that as to cause the mass to be accelerated in phase with the spiral gyration.

9. The method of claim 7 wherein the velocity, V, of the mass at a portion of the spiral path having a radius R is approximately $$V = V_I \frac{R}{R_I} \tag{7}$$

where $R_I$ is the radius of the spiral path where the mass is fed to the spiral path, and $V_I$ is the speed of the mass as the mass is fed to the portion of the spiral path having a radius $R_I$.

10. The method of claim 9 wherein the path distance $R(\phi)$ from a center point of the spiral is proportional to $R_I+K\phi$, where K is a constant and $\phi$ is the angle around the spiral from the region of the spiral where the mass is fed to the spiral path at speed $V_I$.

11. The method of claim 1 further including determining the position of the mass in the path, and controlling movement of the spiral path in response to the determined position.

12. The method of claim 11 wherein the position is determined by a sensory arrangement.

13. The method of claim 11 wherein the position is determined from preprogrammed values for the position of the mass as a function of time.

14. The method of claim 1 wherein the path is relatively rigid and a portion of the track approximately diametrically opposed from the portion of the track where the mass is located is moved in the opposite sense along its local radius of curvature from the direction the path is moved where the mass is located.

15. The method of claim 14 wherein the mass is accelerated and the path portion where the mass is located is moved inwardly and the path portion approximately opposite from where the mass is located is moved outwardly.

16. The method of claim 1 further comprising causing the mass to move in a track having lower than atmospheric pressure to provide a path having a low coefficient of friction for the mass traversing the path.

17. The method of claim 1 further comprising levitating the mass as it moves in the track so the mass as it moves in the track is removed from any mechanical surfaces associated with the track and path to provide a path having a low coefficient of friction for the mass traversing the path.

18. The method of claim 17 wherein the mass is levitated by gas that acts as a gas bearing.

19. The method of claim 17 wherein the mass is levitated by a film of gas formed by vaporizing material from the mass in response to friction being applied to the material as the mass is traversing the path.

20. The method of claim 17 further comprising causing the mass to move in a track having lower than atmospheric pressure to provide a path having a low coefficient of friction for the mass traversing the path.

21. The method of claim 1 wherein the track is moved by a drive mechanism including a rotating shaft connected to the track and further comprising maintaining the speed of the rotating shaft approximately constant while the mass is moved in the track.

22. The method of claim 1 wherein the track is moved by a drive mechanism including plural rotating shafts connected to different locations about the track and further comprising maintaining the speed of the rotating shafts approximately constant while the mass is moved in the track.

23. Apparatus for moving a mass to a high speed comprising a track having a smooth spiral path, the path being arranged and constructed to receive the mass so the mass can traverse the spiral path; and a drive for moving the path so a portion of the spiral path where the mass is located is moved substantially radially along a local radius of curvature of the path.

24. The apparatus of claim 23 wherein the drive for moving the spiral track includes a rotating shaft eccentrically connected to the path.

25. The apparatus of claim 23 wherein the drive for moving the track includes plural rotating shafts connected to different locations about the track, each of the shafts being eccentrically connected to the track.

26. The apparatus of claim 24 further including a crank connected between each rotating shaft and the path.

27. The apparatus of claim 26 wherein each crank includes a counterweight, each rotating shaft being between the connection of the crank to the track and the counterweight.

28. The apparatus of claim 23 wherein the track is relatively rigid, the drive for driving the track being arranged so a portion of the track approximately diametrically opposed from the portion of the track where the mass is located is moved in the opposite sense along its local radius of curvature from the direction the track is moved where the mass is located.

29. The apparatus of claim 28 wherein the mass is accelerated and the drive for moving is activated so the path portion where the mass is located is outside of a mean position of the path and the path portion approximately opposite from where the mass is located is inside of a mean position of the path.

30. The apparatus of claim 29 further wherein the track is arranged to have lower than atmospheric pressure to provide a low friction path for the mass traversing the path.

31. The apparatus of claim 29 further comprising a levitator for levitating the mass as it moves in the track so the mass is removed from any mechanical surfaces associated with the track and path to provide a path having a low coefficient of friction for the mass traversing the path.

32. The apparatus of claim 31 wherein the track is arranged to have lower than atmospheric pressure to provide a path having a low coefficient of friction for the mass traversing the path.

33. Apparatus for changing the velocity of a mass from an initial non-zero velocity to another non-zero velocity comprising a spiral track having a first end for receiving the mass while the mass is at the initial velocity, the track and the mass being arranged so the mass can move in the track after the mass has been received in the track at the initial non-zero velocity, a drive for gyrating the spiral track about an axis as the mass is moving in the spiral track, the drive and track being arranged to cause the mass to change velocity from the initial velocity to another velocity.

34. Apparatus of claim 33 wherein the drive and track are arranged so the mass makes each turn around the spiral track in about the same period of time.

35. Apparatus of claim 33 wherein the drive includes plural rotary drive shafts eccentrically connected to the track at plural places.

36. Apparatus of claim 35 wherein the plural different drive shafts are connected to plural places along each turn of the spiral track.

37. Apparatus of claim 36 wherein the drive shafts and track are arranged so points on one side of a particular spiral turn where the mass is located are outside a local mean position of the track and the points on a second side of the particular spiral turn remote from where the mass is located are inside a local mean position of the track.

38. Apparatus of claim 33 wherein the drive includes a rotary drive shaft eccentrically and fixedly connected to the track, the track and drive being arranged so places on one side of a particular spiral turn where the mass is located are driven toward the axis and places on a second side of the particular spiral turn remote from where the mass is located are driven away from the axis.

39. Apparatus of claim 38 wherein the drive, mass and track are arranged such that the time periods for the mass to traverse each turn of the track are approximately equal.

40. Apparatus of claim 38 wherein the drive, mass and track are arranged such that the places on one side of a particular spiral turn where the mass is located are driven toward the axis and the places on a second side of the particular spiral turn remote from where the mass is located are driven away from the axis, the drive eccentrically gyrating the track at a constant frequency having a period approximately equal to the time periods for the mass to traverse each turn of the track.

41. Apparatus of claim 38 wherein the drive, mass and track are such that the drive eccentrically gyrates the track about the axis at a constant frequency.

42. Apparatus of claim 33 wherein the track is shaped as an Archimedes spiral.

43. A method of increasing the velocity of a mass moving outwardly of an axis of a multi-turn spiral track, the axis being located in proximity to a center portion of the spiral track, the method comprising gyrating the spiral track about the axis in such a manner that the mass completes each turn in the spiral in about the same amount of time.

44. A method of claim 43 wherein the spiral is gyrated at substantially constant speed about the axis.

* * * * *